US008503921B2

(12) United States Patent
Kobayashi

(10) Patent No.: US 8,503,921 B2
(45) Date of Patent: Aug. 6, 2013

(54) MEDIUM SUPPLY DEVICE AND IMAGE FORMING APPARATUS

(75) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1040 days.

(21) Appl. No.: 12/219,999

(22) Filed: Jul. 31, 2008

(65) Prior Publication Data

US 2009/0047038 A1 Feb. 19, 2009

(30) Foreign Application Priority Data

Aug. 16, 2007 (JP) ..... 2007-212444

(51) Int. Cl.
*B41J 29/13* (2006.01)
*B41J 13/00* (2006.01)

(52) U.S. Cl.
CPC ..... *B41J 29/13* (2013.01)
USPC ..... 399/393; 400/693

(58) Field of Classification Search
USPC ..... 271/157; 400/624, 629, 693; 399/393; 347/108
See application file for complete search history.

(56) References Cited

U.S. PATENT DOCUMENTS

| | | | | |
|---|---|---|---|---|
| 4,406,448 | A * | 9/1983 | Kulpa et al. | 271/160 |
| 5,210,573 | A * | 5/1993 | Fukuchi et al. | 399/111 |
| 5,957,447 | A * | 9/1999 | Sekine | 271/9.09 |
| 6,382,617 | B1 * | 5/2002 | Yen et al. | 271/3.14 |
| 6,848,685 | B2 * | 2/2005 | Katsuyama | 271/162 |
| 2003/0209851 | A1 * | 11/2003 | Shin | 271/126 |
| 2008/0013999 | A1 * | 1/2008 | Izuchi | 399/393 |

FOREIGN PATENT DOCUMENTS

| | | | |
|---|---|---|---|
| JP | 06-064761 | | 3/1994 |
| JP | 07267390 | A * | 10/1995 |
| JP | 07277534 | A * | 10/1995 |
| JP | 10059555 | A * | 3/1998 |
| JP | 10231031 | A * | 9/1998 |

* cited by examiner

*Primary Examiner* — Daniel J Colilla
(74) *Attorney, Agent, or Firm* — Kubotera & Associate LLC

(57) ABSTRACT

A medium supply device includes a placing portion for placing a medium; a medium supply unit for picking up at least one medium urged against the medium supply unit from the placing portion; a cover member disposed to be movable; and a regulating member attached to the cover member for separating the placing portion from the medium supply unit when the cover member moves.

4 Claims, 12 Drawing Sheets

MEDIUM SUPPLY DEVICE AND IMAGE FORMING APPARATUS

BACKGROUND OF THE INVENTION

The present invention relates to a medium supply device and an image forming apparatus.

In a conventional image forming apparatus such as an electro-photography printer is provided with a medium cassette having a medium placing portion. In general, the medium cassette is arranged to be detachable relative to a main body of the conventional image forming apparatus. The medium cassette includes a first style in which a whole portion of the cassette is completely retained inside the conventional image forming apparatus (completely retained style), and a second style in which only a part of the cassette is retained inside the conventional image forming apparatus (partially retained style).

In the medium cassette of the completely retained style, it is possible to prevent dusts from attaching to a recording medium stored therein. In the conventional image forming apparatus, it is necessary to provide an urging member such as a spring for urging a recording medium toward a sheet supply roller, so that the recording medium is pressed against the sheet supply roller as a medium supply member. In the medium cassette of the completely retained style, it is possible to provided the urging member in the medium cassette itself. That is, the medium cassette is provided with a function of regulating or releasing an urging force of the urging member accompanied with an operation of attaching or detaching the medium cassette to or from the conventional image forming apparatus.

In the past, only a large size and high performance printer or copier is provided with the medium cassette having the function of regulating or releasing an urging force against the recording medium stored therein. On the other hand, most of small and less expensive printers are provided with the cassette of the partially retained style, in which only a part of the cassette is retained inside the conventional image forming apparatus (refer to Patent Reference).

Patent Reference: Japan Patent Publication No. 06-64761

Instead of the medium cassette arranged to be detachable, another conventional image forming apparatus is provided with a medium placing portion integrated with a main body thereof, thereby reducing a cost. In such a conventional image forming apparatus, a sheet supply roller is urged toward a medium, so that it is possible to supply the medium on the medium placing portion.

In the conventional image forming apparatus, the urging force is applied to the medium thus placed all the time. Accordingly, it is difficult to set the medium on the medium placing portion to replenish the medium. That is, when the medium is replenished, it is necessary to set the medium on the medium placing portion after the urging force applied to the medium is released to secure a space between a medium supply member and the medium.

In view of the problems described above, an object of the invention is to provide a medium supply device and an image forming apparatus, in which it is possible to solve the problems of the conventional image forming apparatus. In the present invention, it is possible to easily set a recording medium even when a member for regulating or releasing an urging force against the recording medium is provided in a main body of the image forming apparatus.

Further objects of the invention will be apparent from the following description of the invention.

SUMMARY OF THE INVENTION

In order to attain the objects described above, according to a first aspect of the present invention, a medium supply device includes a placing portion for placing a medium; a medium supply unit for picking up at least one medium urged against the medium supply unit from the placing portion; a cover member disposed to be movable; and a regulating member attached to the cover member for separating the placing portion from the medium supply unit when the cover member moves.

According to a second aspect of the present invention, an image forming apparatus includes an image forming unit for forming an image on a medium; a placing portion disposed to be movable in a vertical direction for placing the medium; a medium supply device for supplying the medium to the image forming unit; a first cover member for covering the image forming unit to open and close; a second cover member for covering the medium thus placed; a regulating member attached to the second cover member for separating the placing portion from the medium supply unit when the second cover member opens; and a gear row for opening the second cover member when the first cover member opens. The medium supply device includes a medium supply unit for supplying the medium urged against the medium supply unit to the image forming unit.

In the first aspect of the present invention, when the cover member moves, the regulating member moves the placing portion away from the medium supply unit. Accordingly, it is possible to easily replenish the medium on the placing portion.

DETAILED DESCRIPTION OF THE PREFERRED EMBODIMENTS

Figure 1:
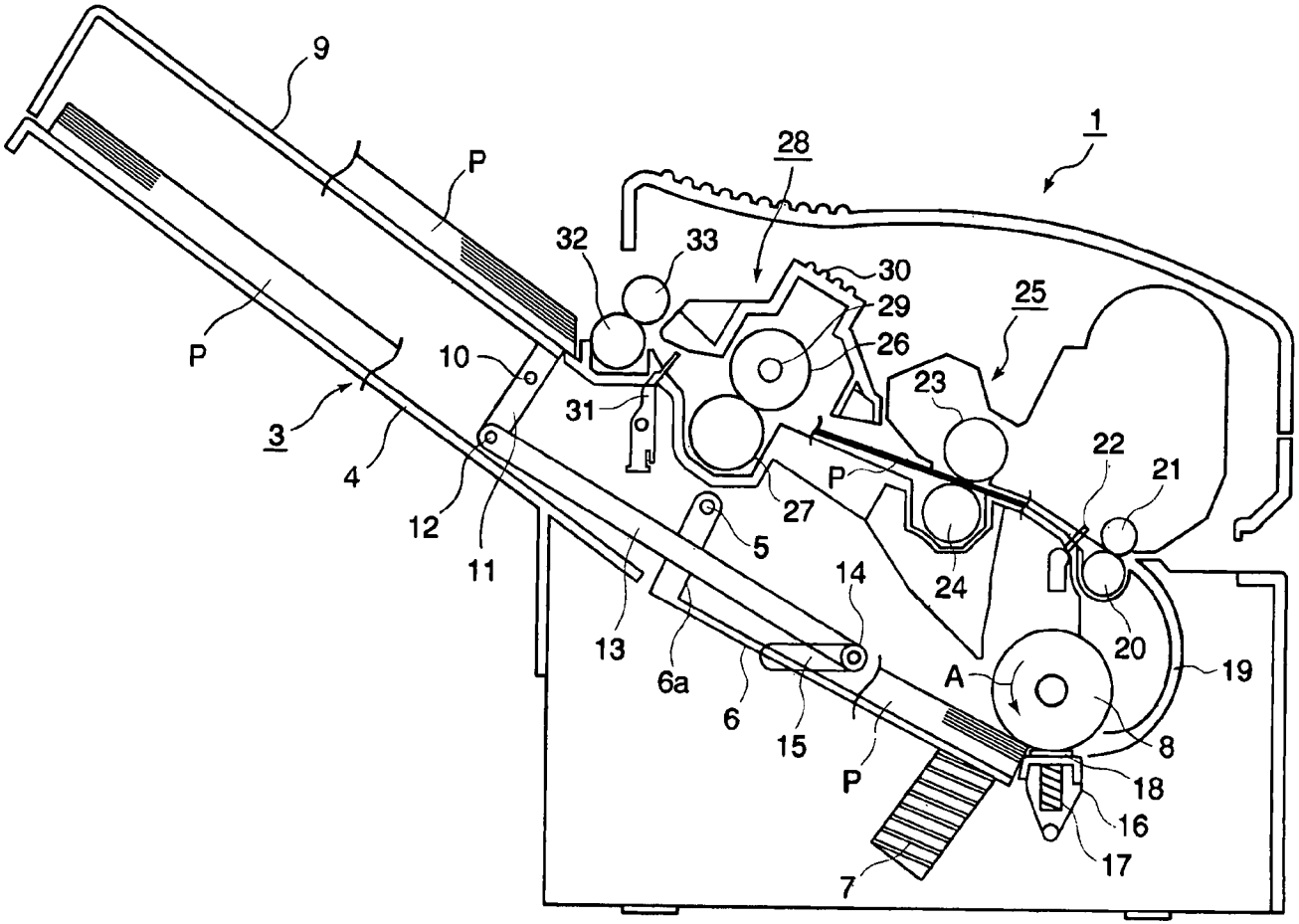
FIG. 1 is a schematic sectional view showing a printer according to a first embodiment of the present invention.

Hereunder, embodiments of the present invention will be described in detail with reference to the accompanying drawings. Components common in the drawings are designated with same reference numerals.

First Embodiment

Figure 2:
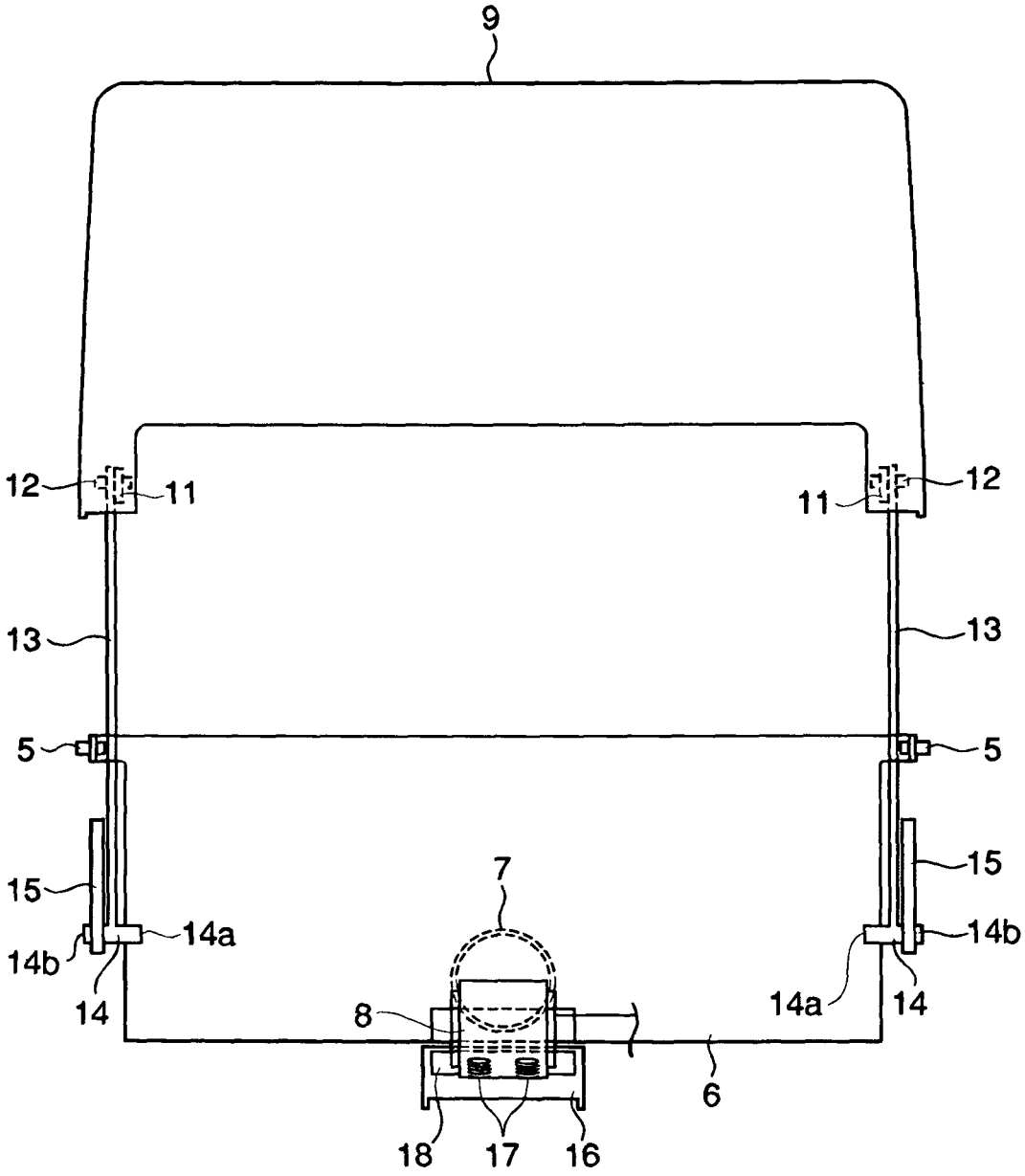
FIG. 2 is a schematic plan view showing the printer according to the first embodiment of the present invention.

A first embodiment of the present invention will be explained. FIG. 1 is a schematic sectional view showing a printer 1 according to the first embodiment of the present invention. FIG. 2 is a schematic plan view showing the printer 1 according to the first embodiment of the present invention.

As shown in FIGS. 1 and 2, the printer 1 as an image forming apparatus includes a medium storage unit 3 for storing a recording medium P. The medium storage unit 3 is formed of a medium tray 4 fixed to the printer 1, and a placing plate 6 disposed inside the printer 1 to be rotatable around supporting portions 5. A trailing end portion of the recording medium P is placed on the medium tray 4, and a front end portion of the recording medium P is placed on the placing plate 6.

In the embodiment, the placing plate 6 includes a pressing spring 7 as an urging member at a front end lower portion thereof. The pressing spring 7 presses the front end portion of the recording medium P placed on the placing plate 6 against a sheet supply roller 8. The placing plate 6 is disposed under the sheet supply roller 8 to be movable in a vertical direction. Supporting members 6*a* are formed at a rear end portion of the placing plate 6 on right and left sides thereof, and the supporting portions 5 are disposed at upper end portions of the supporting members 6*a*.

In the embodiment, a tray cover 9 is attached to the medium tray 4 to be rotatable around a shaft portion 10 for preventing dusts from sticking to the recording medium P. Supporting members 11 are formed at a front end portion of the tray cover 9 to extend downwardly, and the shaft portion 10 is attached to the supporting members 11. The supporting members 11 have lower end portions attached to end portions of link levers 13 with connecting portions 12 to be rotatable. Note that the supporting members 11 and the link levers 13 are disposed on left and right sides of the tray cover 9. Bosses 14 are formed on the other end portions of the link levers 13.

As shown in FIG. 2, the boss 14 has protruding portions 14*a* and 14*b* protruding inwardly and outwardly, respectively. The protruding portion 14*a* protruding inwardly is formed at a position where the protruding portion 14*a* interferes with a side portion of the placing plate 6. The protruding portion 14*b* protruding outwardly is fitted into a groove portion 15 formed in a side surface portion of the printer 1 to be slidable therein.

As shown in FIG. 1, the groove portion 15 extends above and under the placing plate 6. Note that the bosses 14 and the groove portions 15 are disposed on left and right sides of the placing plate 6. The link lever 13 and the boss 14 constitute a regulating member.

In the embodiment, a separation frame 16 is disposed under the sheet supply roller 8 for separating the recording medium P picked up with the sheet supply roller 8 one by one. A separation spring 17 presses the separation frame 16 against the sheet supply roller 8. A separation rubber 18 having a high friction coefficient is attached to the separation frame 16 on a side of the sheet supply roller 8. A transportation path 19 is formed on a right side of the sheet supply roller 8 to extend upwardly. The transportation path 19 turns over the recording medium P by 180 degrees and transports the recording medium P to an image forming unit 25 (described later).

In the embodiment, a transportation roller pair formed of a resister roller 20 and a pressure roller 21 is disposed in the transportation path 19. A passing sensor 22 is disposed on a downstream side of the transportation roller pair in a transportation direction for detecting the recording medium P passing therethrough.

In the embodiment, the image forming unit 25 includes a photosensitive drum 23 and a transfer roller 24, and is disposed on a downstream side of the passing sensor 22. An image fixing unit 28 includes a heat roller 26 and a pressing roller 27, and is disposed on a downstream side of the image forming unit 25. A halogen lamp 29 is arranged inside the heat roller 26 as a heat source. A fixing cover 30 covers the image fixing unit 28. A discharge sensor 31 is disposed on a downstream side of the image fixing unit 28 in the transportation direction for detecting the recording medium P with an image fixed thereon. Discharge rollers 32 and 33 are disposed on a downstream side of the discharge sensor 31 for discharging the recording medium P on the tray cover 9.

An operation from printing an image on the recording medium P to discharging the recording medium P will be explained next. As shown in FIG. 1, the recording medium P is placed on the placing plate 6 of the medium storage unit 3, and the pressing spring 7 presses the recording medium P against the sheet supply roller 8. When a printing operation is started, a motor (not shown) drives all rollers except the sheet supply roller 8, the resister roller 20, and the pressure roller 21, thereby preparing for the printing operation. Afterward, an electromagnetic clutch is turned on to transmit the drive of the motor to the sheet supply roller 8 and the resister roller 20, so that the sheet supply roller 8 and the resister roller 20 start rotating.

When the sheet supply roller 8 rotates in an arrow direction A, the recording medium P on the placing plate 6 situated at an upper most position is picked up to the transportation path 19. When several recording media are picked up, the separation rubber 18 of the separation frame 16 pressed against the sheet supply roller 8 with the separation spring 17 separates a second and subsequent media. Accordingly, only the recording medium P situated at the upper most position enters the transportation path 19.

When the recording medium P enters the transportation path 19, the resister roller 20 and the pressure roller 21 transport the recording medium P to the image forming unit 25. When the recording medium P passes through the passing sensor 22, an apparatus control unit (not shown) sends a direction to the image forming unit 25, so that a toner image is formed on a surface of the photosensitive drum 23. Then, the photosensitive drum 23 rotates in synchronization with a timing that the recording medium P is transported, so that the transfer roller 24 transfers the toner image on the photosensitive drum 23 to the recording medium P.

After the transfer roller 24 transfers the toner image, the recording medium P is transported to the image fixing unit 28. In the image fixing unit 28, the halogen lamp 29 and a thermistor (not shown) uniformly heat the heat roller 26 at a high temperature, and a pressing spring presses the pressing roller 27 against the heat roller 26. Accordingly, when the recording medium P passes through between the heat roller 26 and the pressing roller 27, the toner image is processed at a high temperature and high pressure, thereby fixing the toner image to the recording medium P.

After the toner image is fixed to the recording medium P, the discharge rollers 32 and 33 discharge the recording medium P on the tray cover 9. At this moment, the discharge sensor 31 confirms that an abnormality such as a jam does not occur. Through the steps described above, the operation of forming the image on the recording medium P and discharging the recording medium P is completed.

Figure 3:
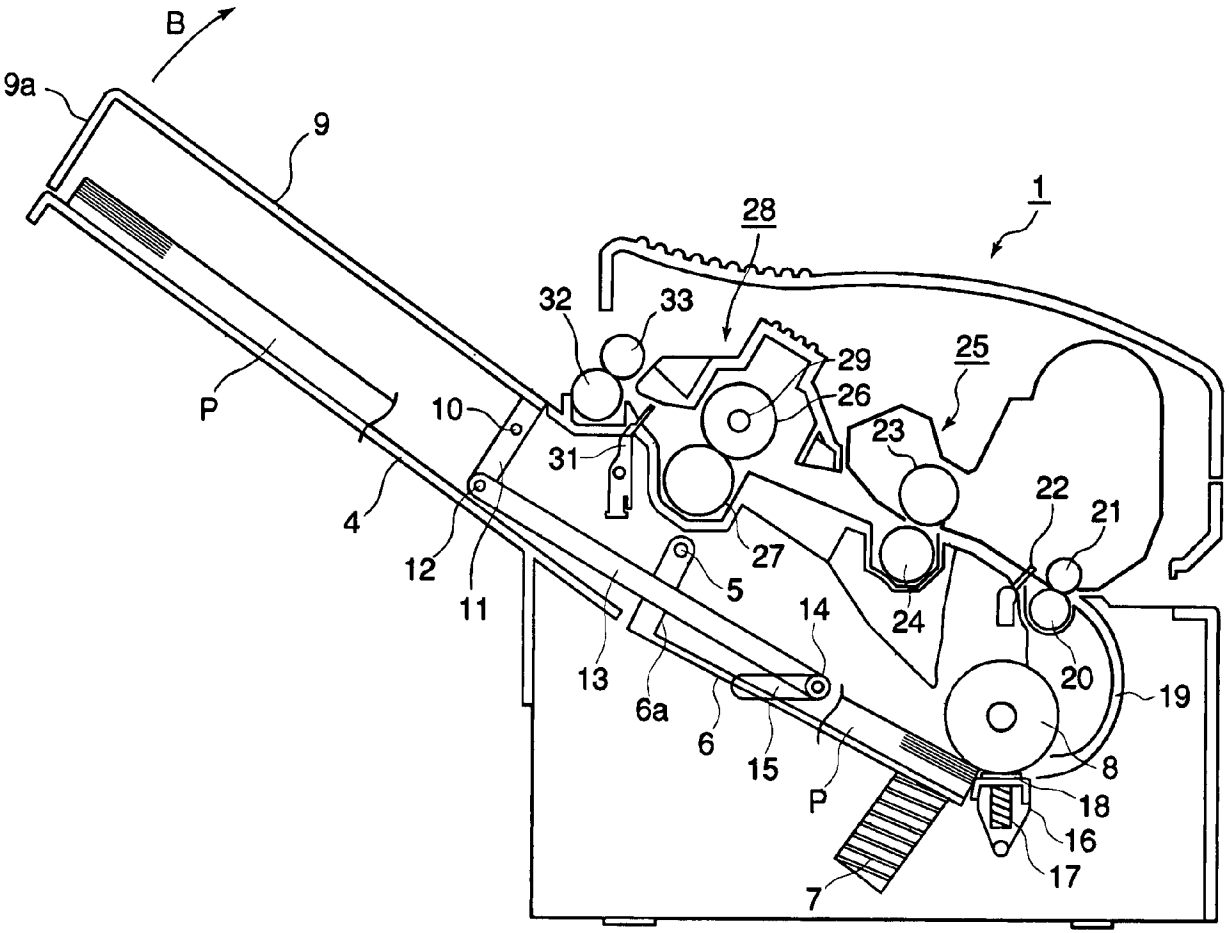
FIG. 3 is a schematic view No. 1 showing a sheet supply device in an operational state according to the first embodiment of the present invention.
Figure 4:
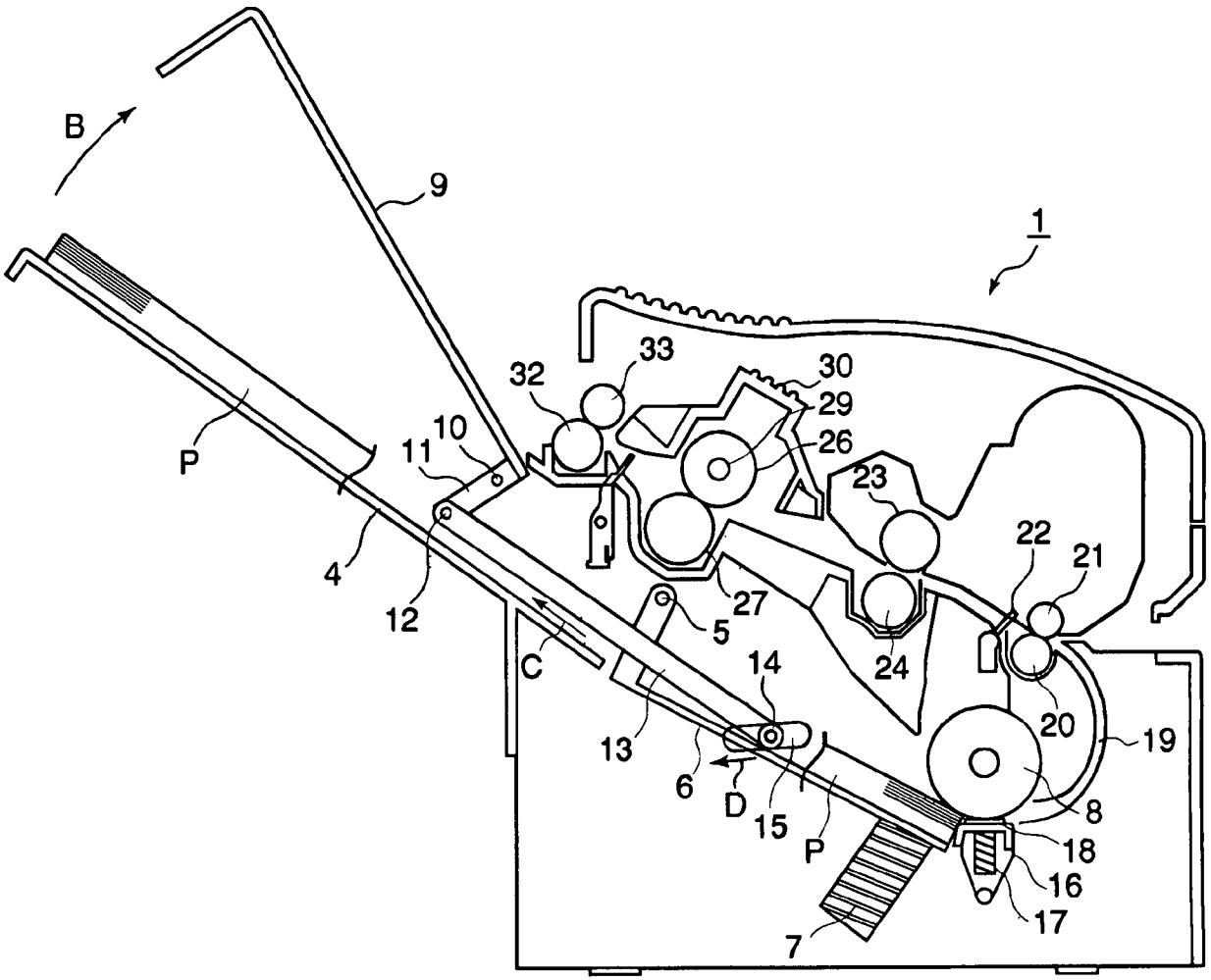
FIG. 4 is a schematic view No. 2 showing the sheet supply device in the operational state according to the first embodiment of the present invention.
Figure 5:
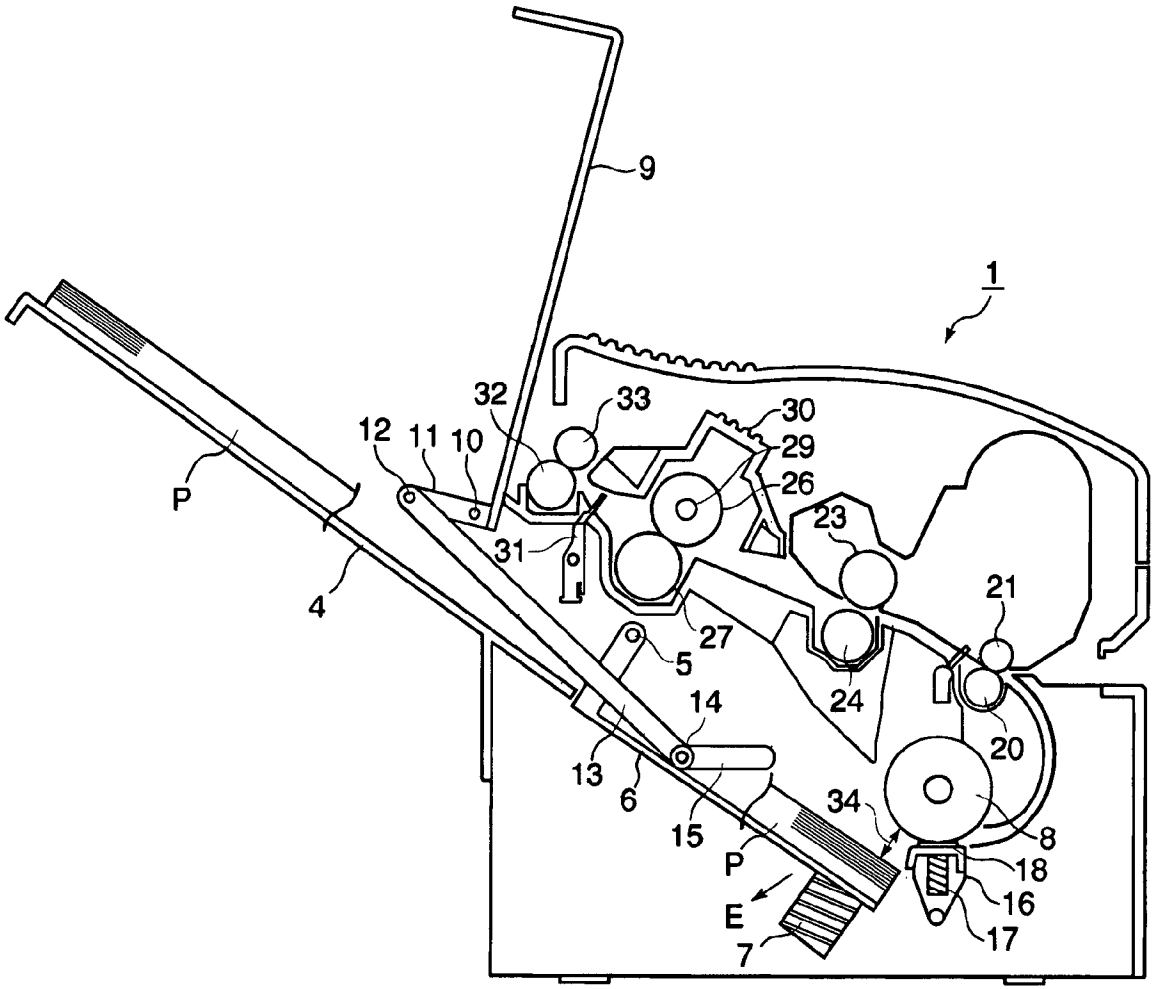
FIG. 5 is a schematic view No. 3 showing the sheet supply device in the operational state according to the first embodiment of the present invention.
Figure 6:
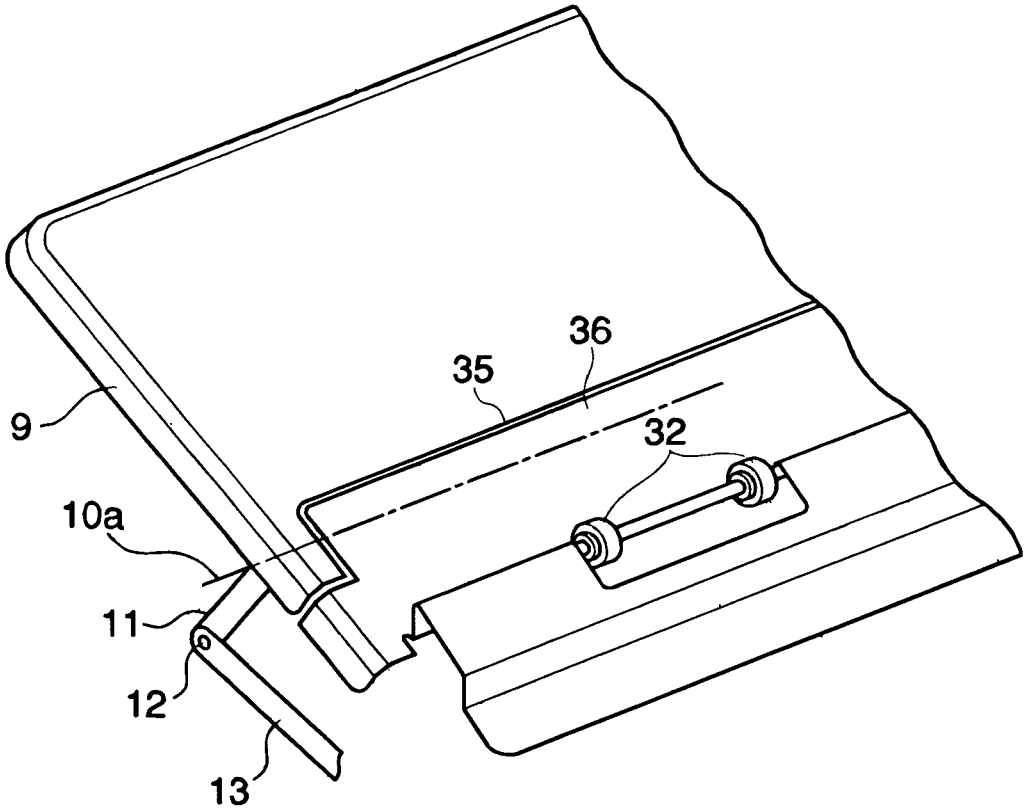
FIG. 6 is a schematic perspective view No. 1 showing a tray cover according to the first embodiment of the present invention.
Figure 7:
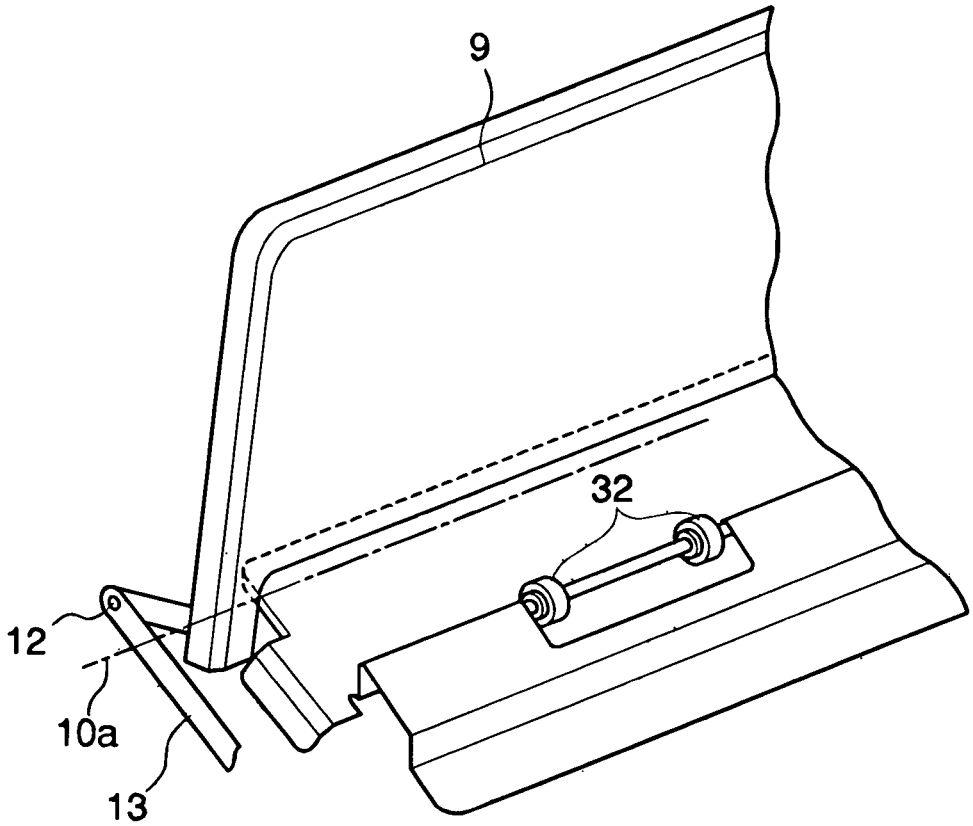
FIG. 7 is a schematic perspective view No. 2 showing the tray cover according to the first embodiment of the present invention.

An operation of setting the recording medium P in the medium storage unit 3 will be explained next. FIG. 3 is a schematic view No. 1 showing the sheet supply device in an operational state according to the first embodiment of the present invention. FIG. 4 is a schematic view No. 2 showing the sheet supply device in the operational state according to the first embodiment of the present invention. FIG. 5 is a schematic view No. 3 showing the sheet supply device in the operational state according to the first embodiment of the present invention. FIG. 6 is a schematic perspective view No. 1 showing the tray cover 9 according to the first embodiment of the present invention. FIG. 7 is a schematic perspective view No. 2 showing the tray cover 9 according to the first embodiment of the present invention.

In the state shown in FIG. 3, the tray cover 9 is closed. From this state, when an upper edge portion 9a of the tray cover 9 moves in an arrow direction B, the tray cover 9 rotates in the arrow direction B around the shaft portion 10, i.e., an opening operation. At a first glance, the tray cover 9 appears to interfere with a main body of the printer 1.

As shown in FIG. 6, the tray cover 9 is provided with a concave portion 35 relative to the main body of the printer 1, and the printer 1 has a convex portion 36 relative to the concave portion 35. Accordingly, in an actual case, when the tray cover 9 becomes an open state, the tray cover 9 does not interfere with the main body of the printer 1 as shown in FIG. 7. In FIGS. 6 and 7, the tray cover 9 rotates around a rotational center 10*a*.

In the embodiment, when the tray cover 9 starts opening, the supporting members 11 rotate around the shaft portion 10 in a clockwise direction. Accordingly, the link levers 13 connected to the connecting portions 12 rotate in an arrow direction C shown in FIG. 4. As a result of the rotation, the protruding portions 14*b* of the bosses 14 formed on the other end portions of the link levers 13 move in the groove portions 15 in an arrow direction D shown in FIG. 4, or in a lower oblique direction.

When the protruding portions 14*b* of the bosses 14 move in the groove portions 15 in the arrow direction D, the protruding portions 14*a* formed on an inner side contact with the placing plate 6 as shown in FIG. 4. At the time when the protruding portions 14*a* contact with the placing plate 6, the pressing spring 7 still presses the recording medium P thus placed against the sheet supply roller 8.

When the tray cover 9 opens further in the arrow direction B, the protruding portions 14*a* of the bosses 14 push the placing plate 6 downwardly. As described above, the placing plate 6 is arranged to be rotatable around the supporting portions 5. Accordingly, the placing plate 6 is pushed against an urging force of the pressing spring 7 downwardly (in an arrow direction E) as shown in FIG. 5.

When the protruding portions 14*b* of the bosses 14 abut against lower end portions of the groove portions 15, the placing plate 6 stops. At this moment, the bosses 14 completely regulate the urging force of the pressing spring 7 against the recording medium P.

More specifically, as shown in FIG. 5, the recording medium P is separated from the sheet supply roller 8, and a space 34 is formed between the recording medium P and the sheet supply roller 8. Accordingly, it is possible to easily place a new recording medium on the recording medium P thus placed already.

When the tray cover 9 opens completely, the tray cover 9 is situated on a right side of the shaft portion 10, that is, at a position opposite to a position that the tray cover 9 is closed relative to the shaft portion 10. Accordingly, even the tray cover 9 is released from a hand, the tray cover 9 does not freely fall and return to a closed state shown in FIG. 3. As a result, an operator can set the recording medium P with a hand thereof off from the tray cover 9.

After the recording medium P is set, when the tray cover 9 rotates from the open state in a closing direction, an operation reversed from the operation described above is performed, so that the recording medium P on the placing plate 6 is pressed against the sheet supply roller 8.

As described above, in the embodiment, when the tray cover 9 of the medium tray 4 opens, the placing plate 6 pressing the recording medium P against the sheet supply roller 8 is pushed down with the link levers 13 and the bosses 14. Accordingly, the space 34 is formed between the recording medium P and the sheet supply roller 8. As a result, it is possible to easily set the recording medium P without receiving the urging force from the placing plate 6.

Second Embodiment

Figure 8:
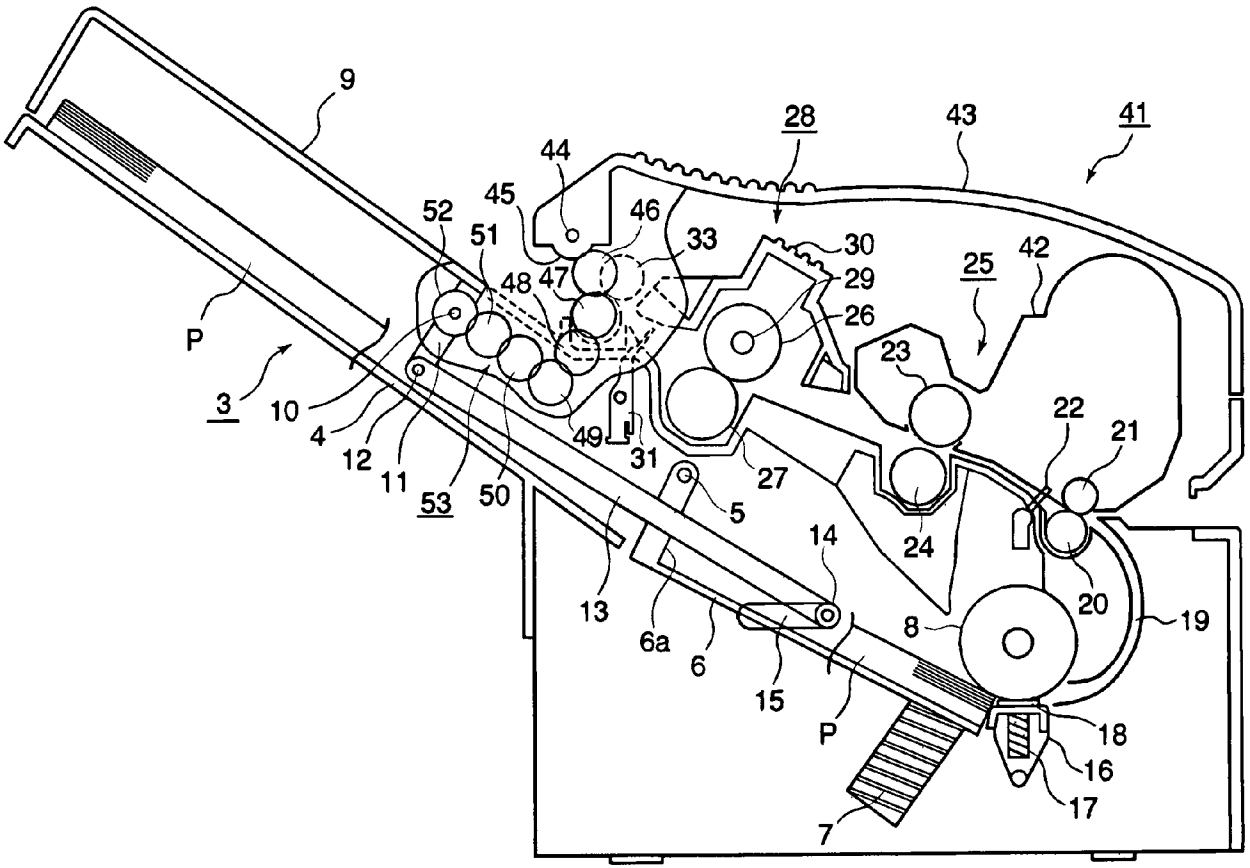
FIG. 8 is a schematic sectional view showing a printer according to a second embodiment of the present invention.

A second embodiment of the present invention will be explained next. FIG. 8 is a schematic sectional view showing a printer 41 according to the second embodiment of the present invention.

As shown in FIG. 8, similar to the first embodiment, the printer 41 includes the medium storage unit 3 for storing the recording medium P. The medium storage unit 3 is formed of the medium tray 4 fixed to the printer 41, and the placing plate 6 disposed inside the printer 41 to be rotatable around the supporting portions 5. The trailing end portion of the recording medium P is placed on the medium tray 4, and the front end portion of the recording medium P is placed on the placing plate 6.

In the embodiment, the placing plate 6 includes the pressing spring 7 as an urging member at the front end lower portion thereof. The pressing spring 7 presses the placing plate 6, so that the front end portion of the recording medium P placed on the placing plate 6 is pressed against the sheet supply roller 8. The placing plate 6 is disposed under the sheet supply roller 8 to be movable in the vertical direction. The supporting members 6*a* are formed at the rear end portion of the placing plate 6 on right and left sides thereof, and the supporting portions 5 are disposed at the upper end portions of the supporting members 6*a*.

In the embodiment, the tray cover 9 is attached to the medium tray 4 to be rotatable around the shaft portion 10 for preventing dusts from sticking to the recording medium P. The supporting members 11 are formed at the front end portion of the tray cover 9 to extend downwardly, and the shaft portion 10 is attached to the supporting members 11. The supporting members 11 have the lower end portions attached to the end portions of the link levers 13 with the connecting portions 12 to be rotatable. Note that the supporting members 11 and the link levers 13 are disposed on the left and right sides of the tray cover 9. The bosses 14 are formed on the other end portions of the link levers 13.

Similar to that shown in FIG. 2, the boss 14 has the protruding portions 14*a* and 14*b* protruding inwardly and outwardly, respectively. The protruding portion 14*a* protruding inwardly is formed at the position where the protruding portion 14*a* interferes with the side portion of the placing plate 6. The protruding portion 14*b* protruding outwardly is fitted into the groove portion 15 formed in the side surface portion of the printer 41 to be slidable. The groove portion 15 extends above and under the placing plate 6. Note that the bosses 14 and the groove portions 15 are disposed on the left and right sides of the placing plate 6.

In the embodiment, the separation frame 16 is disposed under the sheet supply roller 8 for separating the recording medium P picked up with the sheet supply roller 8 one by one. The separation spring 17 presses the separation frame 16 against the sheet supply roller 8. The separation rubber 18 having a high friction coefficient is attached to the separation frame 16 on the side of the sheet supply roller 8. The transportation path 19 is formed on the right side of the sheet supply roller 8 to extend upwardly. The transportation path 19 turns over the recording medium P by 180 degrees and transports the recording medium P to the image forming unit 25.

In the embodiment, the transportation roller pair formed of the resister roller 20 and the pressure roller 21 is disposed in the transportation path 19. The passing sensor 22 is disposed on the downstream side of the transportation roller pair in the transportation direction for detecting the recording medium P passing therethrough.

In the embodiment, the image forming unit 25 includes the photosensitive drum 23 and the transfer roller 24, and is disposed on the downstream side of the passing sensor 22. The image fixing unit 28 includes the heat roller 26 and the pressing roller 27, and is disposed on the downstream side of the image forming unit 25. The halogen lamp 29 is arranged inside the heat roller 26 as the heat source. The fixing cover 30 covers the image fixing unit 28. The discharge sensor 31 is disposed on the downstream side of the image fixing unit 28 in the transportation direction for detecting the recording medium P with an image fixed thereon. The discharge rollers 32 and 33 are disposed on the downstream side of the discharge sensor 31 for discharging the recording medium P on the tray cover 9.

In the embodiment, considering an occurrence of a jam such as paper jam, the image forming unit 25 includes the transfer roller 24 and an ID (image drum) unit 42 having the photosensitive drum 23 and the pressure roller 21. The ID unit 42 is configured to be detachable relative to the printer 41. A device cover 43 is disposed to be rotatable around a rotational shaft portion 44 for opening and closing, so that the ID unit 42 can be removed. An arc portion 45 is formed at one end portion of the device cover 43 with the rotational shaft portion 44 as a circle center thereof. Gear teeth are formed on the arc portion 45.

In the embodiment, a gear row 53 engages the arc portion 45. The gear row 53 is formed of gears 46 to 52. The gear 46 engages the arc portion 45, and the gear 47 engages the gear 46. Similarly, the gears 48 to 52 engage with each other, and the gear 52 is attached to the shaft portion 10 of the tray cover 9.

In the embodiment, the gear 52 transmits a rotation of the device cover 43 transmitted from the gear row 53 to the shaft portion 10, thereby rotating the tray cover 9. Further, the gear 52 is attached to the shaft portion 10 of the tray cover 9, and functions as a torque limiter. Accordingly, when a load larger than a specific level is applied to the gear 52, the gear 52 rotates idle.

An operation of the printer 41 will be explained. An operation of forming an image on the recording medium P is similar to that in the first embodiment, and an explanation thereof is omitted. In the following description, an operation of removing a jammed medium upon an occurrence of the jam such as paper jam in the transportation path 19 will be explained.

Figure 9:
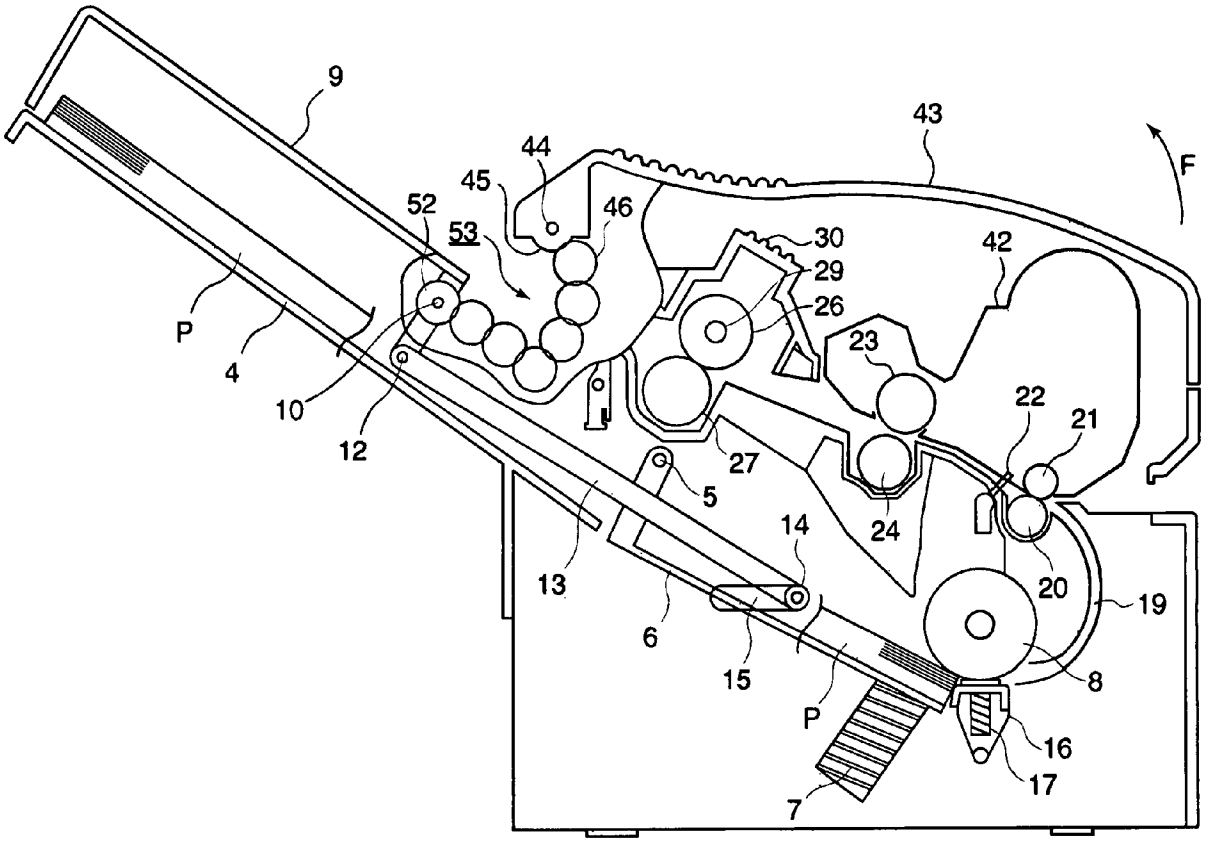
FIG. 9 is a schematic view No. 1 showing a sheet supply device in an operational state according to the second embodiment of the present invention.
Figure 10:
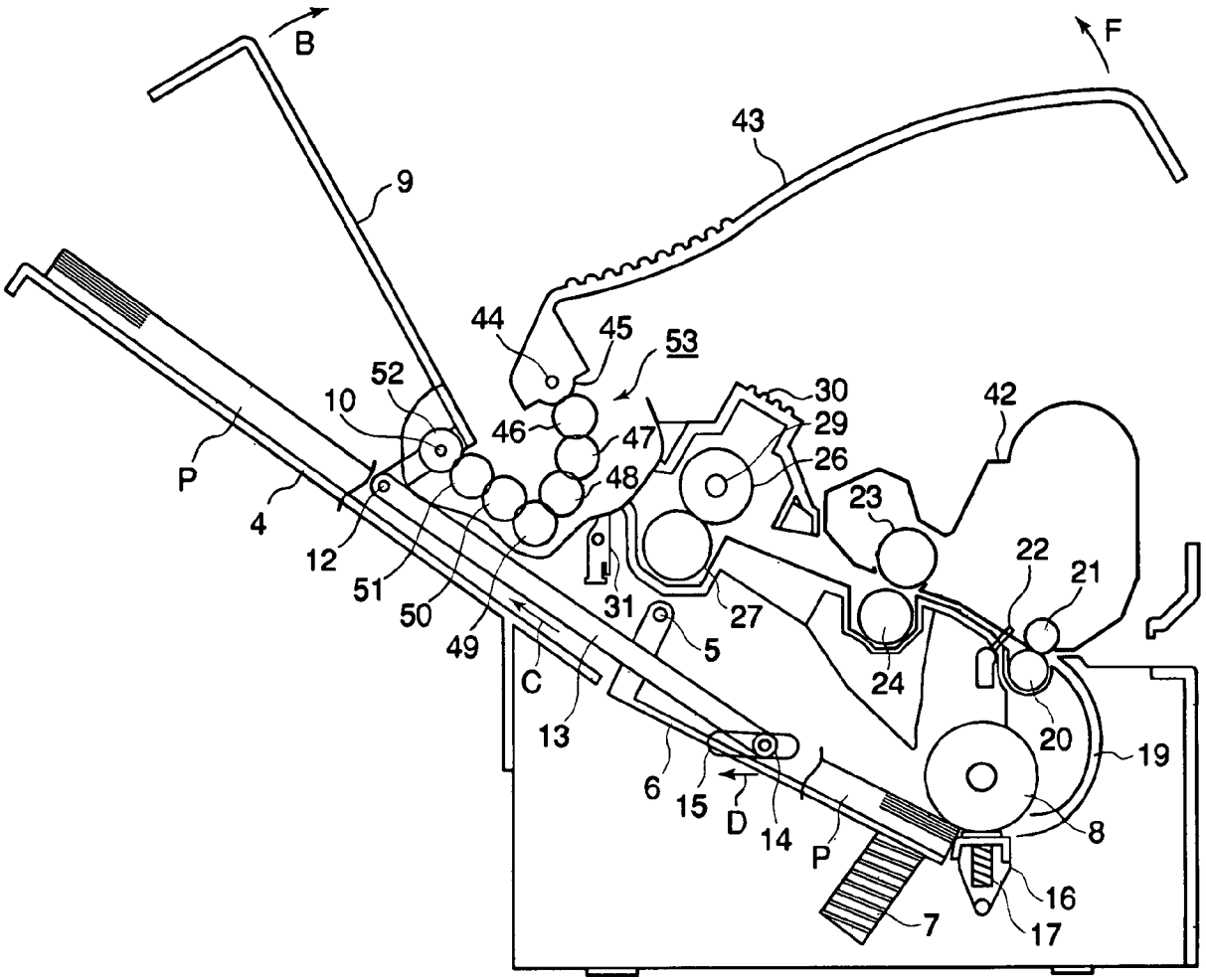
FIG. 10 is a schematic view No. 2 showing the sheet supply device in the operational state according to the second embodiment of the present invention.
Figure 11:
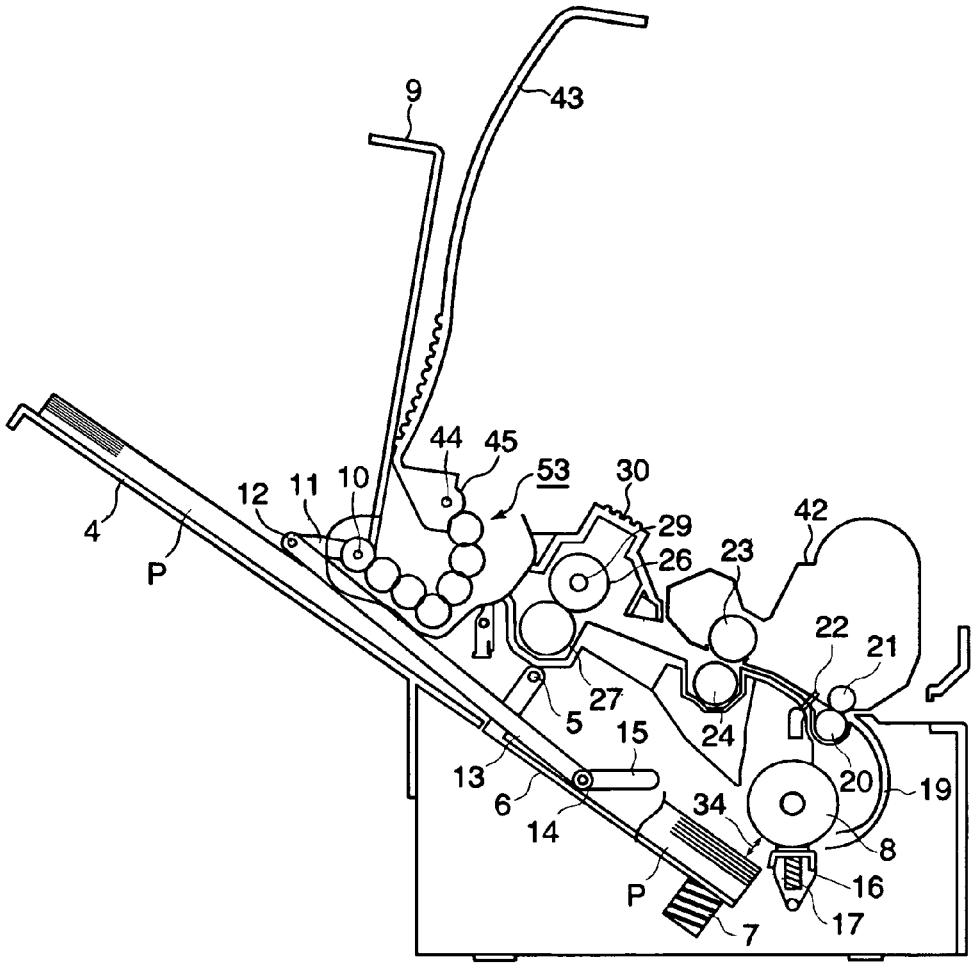
FIG. 11 is a schematic view No. 3 showing the sheet supply device in the operational state according to the second embodiment of the present invention.
Figure 12:
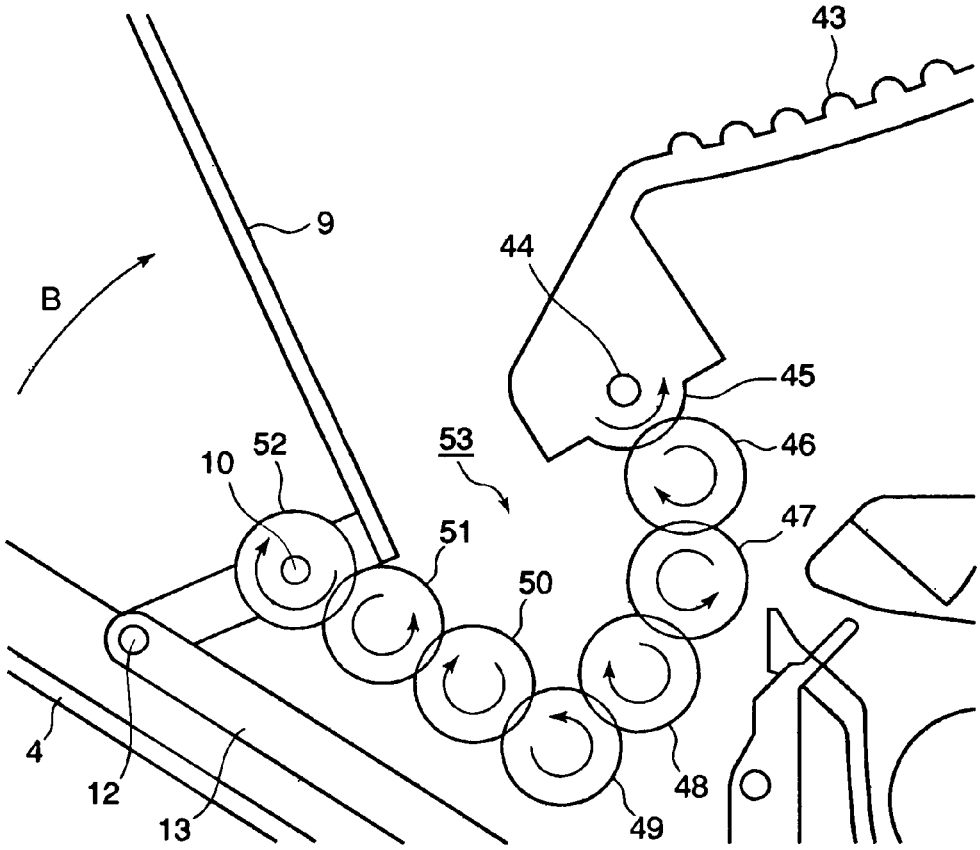
FIG. 12 is a schematic enlarged view showing a gear row in an operation state according to the second embodiment of the present invention.

FIG. 9 is a schematic view No. 1 showing the sheet supply device in an operational state according to the second embodiment of the present invention. FIG. 10 is a schematic view No. 2 showing the sheet supply device in the operational state according to the second embodiment of the present invention. FIG. 11 is a schematic view No. 3 *showing* the sheet supply device in the operational state according to the second embodiment of the present invention. FIG. 12 is a schematic enlarged view showing the gear row 53 in an operation state according to the second embodiment of the present invention.

When the device cover 43 opens slightly from a closed state in an arrow direction F shown in FIG. 9, the device cover 43 rotates in the same direction around the rotational shaft portion 44. At this moment, the arc portion 45 formed at the one end portion of the device cover 43 rotates in the same direction. Accordingly, the gears 46 to 52 of the gear row 53 engaging the arc portion 45 rotate as shown in FIG. 12, respectively, and the gear 52 rotate in a clockwise direction.

As described above, the gear 52 is attached to the shaft portion 10 of the tray cover 9. Accordingly, when the gear 52 rotates, the shaft portion 10 rotates, and the tray cover 9 rotates in the same direction. That is, the tray cover 9 rotates in the opening direction.

FIG. 10 is the schematic view showing a state that the tray cover 9 opens when the device cover 43 opens. Similar to the first embodiment, the link levers 13 connected with the connecting portions 12 move in an arrow direction C shown in FIG. 10. As a result of the rotation, the bosses 14 formed on the other end portions of the link levers 13 move in the groove portions 15 in an arrow direction D shown in FIG. 10, or in a lower oblique direction.

When the bosses 14 move in the groove portions 15 in the arrow direction D, the bosses 14 contact with the placing plate 6. At the time when the bosses 14 contact with the placing plate 6, the pressing spring 7 still presses the recording medium P thus placed against the sheet supply roller 8.

When the device cover 43 opens further and the tray cover 9 opens further in the arrow direction B, the bosses 14 push the placing plate 6 downwardly. As described above, the placing plate 6 is arranged to be rotatable around the supporting portions 5. Accordingly, the placing plate 6 is pushed against the urging force of the pressing spring 7 downwardly as shown in FIG. 11. When the bosses 14 abut against the lower end portions of the groove portions 15, the placing plate 6 stops. At this moment, the bosses 14 completely regulate the urging force of the pressing spring 7 against the recording medium P. Accordingly, as shown in FIG. 11, the recording medium P is separated from the sheet supply roller 8, and the space 34 is formed between the recording medium P and the sheet supply roller 8. As a result, when the ID unit 42 is detached to remove the recording medium P thus jammed, it is possible to easily remove the recording medium P jammed between the sheet supply roller 8 and the placing plate 6.

In the embodiment, the gear 52 attached to the shaft portion 10 of the tray cover 9 functions as the torque limiter. Accordingly, when only the tray cover 9 opens, a load grater than a specific level is applied to the gear 52. As a result, the gear 52 rotates idle, and the rotation is not transmitted to the gear row 53. Therefore, it is possible to open only the tray cover 9 without opening the device cover 43.

As described above, in the second embodiment, when the device cover 43 of the printer 41 opens, the tray cover 9 opens accompanied with the device cover 43. Further, the placing plate 6 is pushed down to move away from the sheet supply roller 8. Accordingly, it is possible to easily remove the recording medium P thus jammed with the simple operation of opening the device cover 43.

In the embodiments described above, it is configured that the placing plate 6 moves away from the sheet supply roller 8 when the tray cover 9 opens. Alternatively, it may be configured that the sheet supply roller 8 moves away from the placing plate 6.

In the embodiments described above, the printer is explained as the image forming apparatus. The present invention is applicable to an image forming apparatus such as a multi-function product, a facsimile, a copier, and the like.

The disclosure of Japanese Patent Application No. 2007-212444, filed on Aug. 16, 2007, is incorporated in the application by reference.

While the invention has been explained with reference to the specific embodiments of the invention, the explanation is illustrative and the invention is limited only by the appended claims.

What is claimed is:

1. An image forming apparatus comprising:

an image forming unit for forming an image on a medium, a placing portion disposed to be movable in a vertical direction for placing the medium;

a medium supply device for supplying the medium to the image forming unit, said medium supply device including a medium supply unit for supplying the medium urged against the medium supply unit to the image forming unit;

a first cover member for covering the image forming unit to open and close;

a second cover member for covering the medium thus placed;

a regulating member attached to the second cover member for separating the placing portion from the medium supply unit when the second cover member opens; and a gear row for opening the second cover member when the first cover member opens.

2. The image forming apparatus according to claim 1, wherein said gear row includes a torque limiter for disconnecting the second cover member from the first cover member.

3. An image forming apparatus comprising:

an image forming portion for forming an image on a medium;

a medium supply unit for transporting the medium urged against the medium supply unit to the image forming portion;

a placing portion to be movable in a first direction approaching toward the medium supply unit and a second direction away from the medium supply unit for placing the medium;

a cover member disposed to be capable of opening and closing the image forming portion; and a regulating member attached to the cover member for separating the placing portion from the medium supply unit when the cover member moves, wherein said regulating member includes a link lever connected to the cover member to be rotatable, and a boss portion disposed at an end portion of the link lever to be movable between above and below the placing portion.

4. The image forming apparatus according to claim 3, wherein said regulating member is arranged to move the medium placed on the placing portion away from the medium supply unit when the cover member moves to an open position, said regulating member being arranged to move the medium placed on the placing portion toward the medium supply unit when the cover member moves to a close position.

* * * * *